US007454032B2

(12) United States Patent
Tomiyama et al.

(10) Patent No.: US 7,454,032 B2
(45) Date of Patent: Nov. 18, 2008

(54) MAGNESIUM DIAPHRAGM, METHOD OF MANUFACTURING THE SAME, AND SPEAKER APPARATUS

(75) Inventors: Hiroyuki Tomiyama, Tendo (JP); Masatoshi Sato, Tendo (JP); Satoshi Hachiya, Tendo (JP); Kouichi Honma, Mitsuke (JP)

(73) Assignee: Pioneer Corporation, Tokyo (JP)

( * ) Notice: Subject to any disclaimer, the term of this patent is extended or adjusted under 35 U.S.C. 154(b) by 711 days.

(21) Appl. No.: 10/921,911

(22) Filed: Aug. 20, 2004

(65) Prior Publication Data

US 2005/0041828 A1 Feb. 24, 2005

(30) Foreign Application Priority Data

Aug. 22, 2003 (JP) ..... 2003-208374

(51) Int. Cl.
*H04R 25/00* (2006.01)

(52) U.S. Cl. ..... 381/423; 381/424; 381/426; 29/594

(58) Field of Classification Search ..... 381/423–424, 381/426–427, 124; 29/594
See application file for complete search history.

(56) References Cited

U.S. PATENT DOCUMENTS

| | | | | |
|---|---|---|---|---|
| 2,538,831 | A | 1/1951 | Cutter | 204/56 |
| 4,726,443 | A | 2/1988 | Ugaji et al. | 181/167 |
| 2006/0104473 | A1 * | 5/2006 | Polfreman et al. | 381/424 |

FOREIGN PATENT DOCUMENTS

| | | |
|---|---|---|
| EP | 0 978 576 A1 | 2/2000 |
| JP | 61-84998 | 4/1986 |
| JP | 11-236698 | 8/1999 |
| JP | 2000-152375 | 5/2000 |
| JP | 2000-345370 | 12/2000 |
| JP | 2001-73194 | 3/2001 |
| JP | 2002-369284 | 12/2002 |
| JP | 2003-160898 | 6/2003 |

OTHER PUBLICATIONS

Patent Abstracts of Japan vol. 011, No. 268 (C-444), Aug. 29, 1987 & JP 62 070600 A (Ube Ind Ltd), Apr. 1, 1987 *abstract*.
European Search Report dated Mar. 2, 2007.
Office Action for corresponding Japanese patent application No. 2003-208374 dated May 27, 2008, Notification of Reason(s) for Refusal with English translation.

* cited by examiner

*Primary Examiner*—Suhan Ni
(74) *Attorney, Agent, or Firm*—Kratz, Quintos & Hanson, LLP

(57) ABSTRACT

A substrate (580) made by a thin magnesium plate having a thickness of at most 60 μm and bent in a predetermined shape is subjected to anodic oxidation using an alkali-mixture aqueous solution containing metallic salt with a pH 12 or more so that porous anodic oxide coatings (571) are formed on the surfaces thereof. A first treated substrate (581) having the anodic oxide coatings (571) is immersed in a bath of a dye (571B), which fills the pores (571A) of the anodic oxide coatings (571) and dyes the substrate, providing a second treated substrate (582). The second treated substrate (582) is subjected to electrodeposition using electrodeposition paint made mainly of acrylic resin, forming electrodeposition coatings (572) on the anodic oxide coatings (571). A magnesium diaphragm is thereby produced, which is thin and has sufficient sensitivity and desired characteristics. The diaphragm thus dyed has metallic gloss and hence acquires a high decorative value.

9 Claims, 3 Drawing Sheets

MAGNESIUM DIAPHRAGM, METHOD OF MANUFACTURING THE SAME, AND SPEAKER APPARATUS

BACKGROUND OF THE INVENTION

1. Field of the Invention

The present invention relates to a magnesium diaphragm having an anodic oxide coating on a surface thereof, a method of manufacturing the same, and a speaker apparatus.

2. Description of Related Art

Diaphragms used for speakers known in the art are magnesium diaphragms made of metal whose main component is magnesium. This is because diaphragms made of metal having a relatively large specific gravity, such as aluminum or titanium, have a small internal loss. However, magnesium is more readily rusted than aluminum, titanium and the like. Therefore, a rust-preventive treatment is applied to the surface of the magnesium diaphragms. (See, for example, Reference 1: Japanese Patent Laid-Open Publication No. 2002-369284, page 3, right column to page 4, left column, and Reference 2: Japanese Patent Laid-Open Publication No. Hei 11-236698, page 3, left column to page 5, right column.)

A magnesium diaphragm disclosed in Reference 1 has a layered-structure surface composed of an epoxy resin-based primer layer and an acrylic resin-based top layer. These layers are formed in two steps. First, the primer layer is formed on the magnesium diaphragm by means of baking finish. Then, an acrylic resin-based top layer is formed on the primer layer, also by means of backing finish. Such layered structure enhances not only the anti-corrosiveness of the magnesium diaphragm, but also the decorative value of the diaphragm.

However, this magnesium diaphragm disclosed in Reference 1 is thick and heavy, because the layers are formed by baking finish. Being thick and heavy, the magnesium diaphragm may not exhibit so good characteristics as is desired.

A magnesium diaphragm disclosed in Reference 2 has a layered-structure surface composed of an anodic oxide coating and an electrodeposition coating. Theses coatings are formed in two steps. First, the magnesium diaphragm is subjected to anodic oxidation, forming an anodic oxide coating on the surface. Next, paint composed of a solvent and organic pigment is applied, thereby electrically depositing a color coating on the anodic oxide coating. This layered structure enhances not only the anti-corrosiveness of the magnesium diaphragm, but also the decorative value of the diaphragm.

However, since the electrically deposited color coating for the decoration is thick, the magnesium diaphragm disclosed in Reference 2 is heavy and may fail to exhibit so good characteristics as desired.

As indicated above, since the magnesium diaphragm using the baking finish in Reference 1 and the magnesium diaphragm colored by the electrodeposition after the anodic oxidation in Reference 2 have the thick and heavy coating, the characteristics as the diaphragm might be impaired.

SUMMARY OF THE INVENTION

An object of the present invention is to provide a magnesium diaphragm that is relatively light and hence excels in characteristics and decorative value, a method of manufacturing the magnesium diaphragm, and a speaker apparatus.

In a magnesium diaphragm according to an aspect of the present invention, an anodic oxide coating dyed with a dye is formed on a surface of a thin magnesium plate made mainly of magnesium.

A method of manufacturing a magnesium diaphragm according to another aspect of the present invention, includes the steps of: performing anodic oxidation on a substrate made by a thin magnesium plate bent in a predetermined shape to form an anodic oxide coating on a surface thereof; and dying the substrate having the anodic oxide coating formed on the surface thereof.

A speaker apparatus according to a further aspect of the present invention includes: the above-described magnesium diaphragm; a voice coil secured to the magnesium diaphragm; a magnetic body; and a casing including a yoke holding the magnesium diaphragm and the magnetic body and constituting a magnetic circuit jointly with the magnetic body.

A speaker apparatus according to still a further aspect of the present invention includes: a magnesium diaphragm manufactured according to the above-described method of manufacturing the magnesium diaphragm; a voice coil secured to the magnesium diaphragm; a magnetic body; and a casing including a yoke holding the magnesium diaphragm and the magnetic body and constituting a magnetic circuit jointly with the magnetic body.

BRIEF DESCRIPTION OF THE DRAWINGS

FIG. 3A being a sectional view of a substrate, FIG. 3B being a sectional view of the substrate after anodic oxidation, FIG. 3C being a sectional view showing the substrate after a coloring process, and FIG. 3D being a sectional view of the magnesium diaphragm after a rust-preventive treatment.

DETAILED DESCRIPTION OF PREFERRED EMBODIMENTS

An embodiment of this invention, which is a speaker apparatus, will be described with reference to the accompanying drawings. The apparatus is a small speaker. Nonetheless, the invention can be applied to large speakers, as well.

[Configuration of the Speaker Apparatus]

Figure 1:
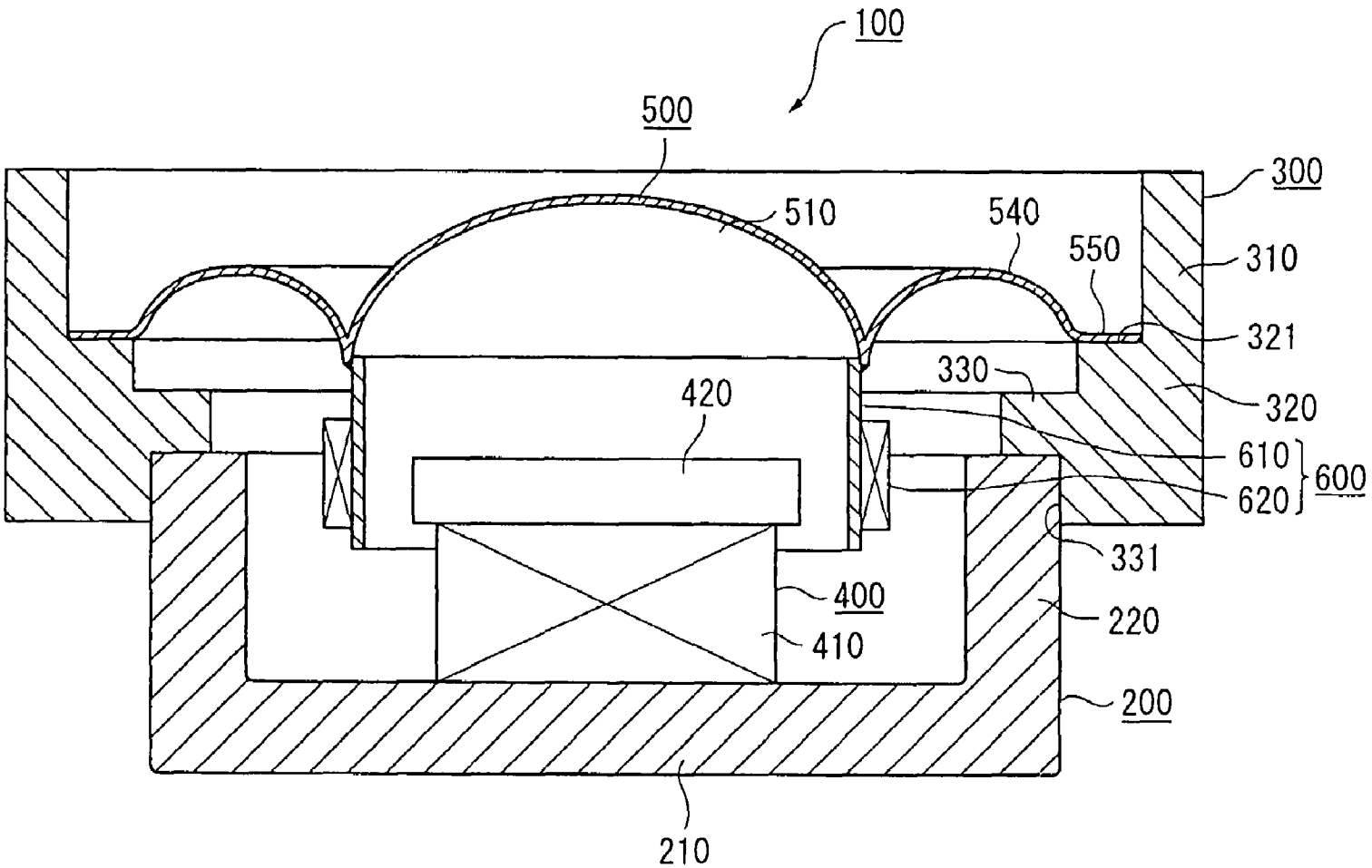
FIG. 1 is a plan view of a speaker apparatus according to an embodiment of the present invention.
Figure 2:
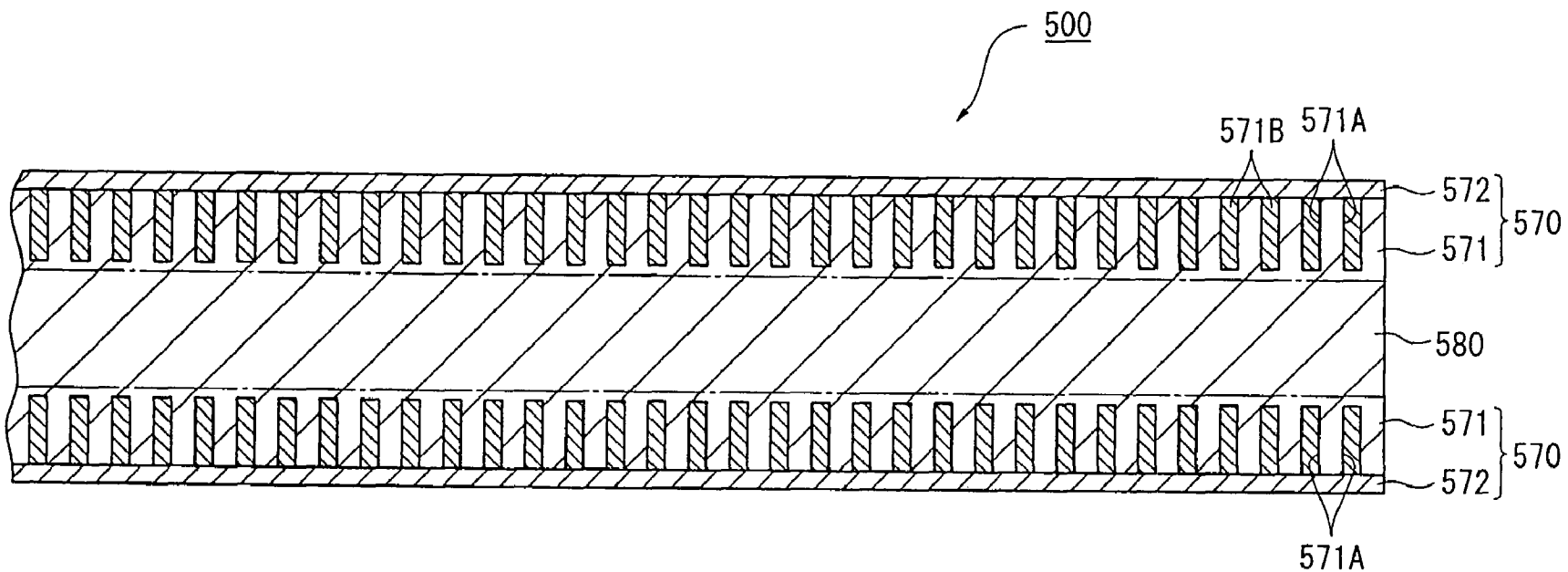
FIG. 2 is a sectional view of a part of a magnesium diaphragm incorporated in the first embodiment.

FIG. 1 is a sectional side view of the speaker apparatus 100. FIG. 2 is a sectional view schematically depicting a part of a magnesium diaphragm provided in the speaker apparatus 100. As FIG. 1 shows, the speaker apparatus 100 converts an audio signal to sound. It is particularly useful as a tweeter that is an apparatus for generating high-frequency sound. The speaker apparatus 100 includes a yoke 200, a frame 300, a magnetic body 400, a magnesium diaphragm 500, a voice coil 600, and a cover (not shown). The yoke 200 and the frame 300 constitute a casing.

The yoke 200 is shaped like a dish and made of magnetic material, such as steel, the main component of which is iron. The yoke 200 has a bottom section 210 and a cylindrical section 220. The bottom section 210 is shaped like a disc. The cylindrical section 220 is connected to the circumference of the bottom section 210 and extends upward to one side of the speaker apparatus 100. Thus, the yoke 200 is dish-shaped.

The frame 300 is ring-shaped and made of either metal such as steel or thermoplastic synthetic resin such as acrylonitrile butadiene styrente resin (ABS). The frame 300 has a body section 310. The body section 310 has an inside diameter that is greater than the outside diameter of the cylindrical section 220 of the yoke 200. The frame 300 has a coupling section 320 formed integral with the body section 310 and protruding inwards from the lower-end part of the body section 310. The coupling section 320 has an inside diameter substantially equal to the outside diameter of the cylindrical section 220. The cylindrical section 220 can therefore inserted into, and pulled from, the coupling section 320. The coupling section 320 has a fitting face 321, at the end that lies above the axis of the coupling section 320. The magnesium diaphragm 500 is secured to the fitting face 321. A mounting section 330 is provided on the inner circumferential surface of the coupling section 320. The lower side of the mounting section 330 and the inner circumferential surface of the coupling section 320 define an engagement step 331. The frame 300 is bonded to the upper end of the cylindrical section 220 of the yoke 200, by adhesive (not shown) that is applied to the engagement step 331.

The magnetic body 400 has a magnet 410 and a yoke plate 420. The magnet 410 made of magnetic material is shaped like a column and has a diameter smaller than the inside diameter of the cylindrical section 220 of the yoke 200. The magnet 410 has two magnetic pole surfaces at the ends, respectively. The magnet 410 is, for example, bonded to the center part of the bottom section 210 of the yoke 200, by using adhesive (not shown), and held substantially coaxial to the yoke 200. The yoke plate 420 made of magnetic material such as steel is shaped like a disc and has a diameter greater than the outside diameter of the magnet 410 and smaller than the inside diameter of the cylindrical section 220. The yoke plate 420 is, for example, bonded to the upper end of the magnet 410 by using adhesive (not shown), and is held substantially coaxial to the magnet 410. Once the yoke plate 420 is thus bonded to the magnet 410, a predetermined magnetic gap is provided between the outer circumferential surface of the yoke plate 420 and the inner circumferential surface of the cylindrical section 220 of the yoke 200.

The speaker apparatus 100 may be one designed to generate high-frequency sound and having an outside diameter of about 500 mm or less. In this case, the magnesium diaphragm 500 has a thin magnesium plate as illustrated in FIG. 2. The thin magnesium plate has a thickness of about 60 μm or less, preferably from 20 μm to 60 μm, or more preferably from 30 μm to 50 μm. As FIG. 2 shows, a layered coating 570 is formed on each side of the thin magnesium plate. The thin magnesium plate may be made of a magnesium metal as well as a magnesium alloy that contains aluminum, zinc, manganese, zirconium or impurities. The magnesium plate may have insufficient rigidity and a great strain if its thickness is less than 20 μm. Alternatively, the magnesium plate becomes heavy and may lower the sensitivity if its thickness is more than 60 μm. This is why the magnesium plate should have a thickness of 60 μm or less, preferably from 20 μm to 60 μm, or more preferably from 30 μm to 50 μm.

As FIG. 1 shows, the magnesium diaphragm 500 has a vibrating section 510, an annular edge section 540, and a flange section 550. The vibrating section 510 is the center part that is curved, having, for example, a semispherical surface. The vibrating section 510 has a diameter larger than that of the yoke plate 420 of the magnetic body 400 and smaller than the inside diameter of the cylindrical section 220 of the yoke 200. The edge section 540 is formed integral with the vibrating section 510 and is curved in the same direction as the vibrating section 510. The flange section 550 is formed integral with the edge section 540 and protrudes outwards. The magnesium diaphragm 500 has a diameter almost the same as the inside diameter of the body section 310 of the frame 300. The magnesium diaphragm 500 is positioned at the body section 310. It is secured to the frame 300, with its flange section 550 bonded to the fitting face 321 of the coupling section 320, by using, for example, adhesive (no shown).

The magnesium diaphragm 500 has been subjected to a rust-preventive treatment. Thus, as FIG. 2 depicts, the layered coatings 570 are provided on the thin magnesium plate. If the layered coatings 570 are 5 μm or less thick, they may fail to prevent the thin magnesium plate from being rusted. In this case, the magnesium diaphragm 500 cannot be used in the speaker apparatus 100, particularly when the speaker apparatus 100 is installed in automobiles. If the layered coatings 570 are 15 μm or more thick, they may make the magnesium diaphragm 500 too heavy, disabling the magnesium diaphragm 500 from performing its function. Hence, it is desired that the layered coatings 570 should have a thickness ranging from 5 μm to 15 μm. Each layered coating 570 has an anodic oxide coating 571 and an electrodeposition coating 572.

The anodic oxide coating 571 is formed by performing anodic oxidation on one side of a substrate 580 that has been prepared by pressing the magnesium plate into a shape of the magnesium diaphragm 500. The anodic oxide coating 571 is very thin, having a thickness of, for example, 0.1 μm to 3 μm. The anodic oxide coating 571 is made mainly of magnesium oxide and is porous, having countless pores 571A. If the anodic oxide coating 571 is less than 0.1 μm thick, it may not impart sufficient anti-corrosiveness to the magnesium diaphragm 500. If the anodic oxide coating 571 is more than 0.3 μm thick, the magnesium diaphragm 500 may not be readily pressed and may not vibrate to generate sound of desired quality. Thus, it is desired that the anodic oxide coating 571 be 0.1 μm to 3 μm thick. In FIG. 2, a line indicates the interface between each anodic oxide coating 571 and the non-oxidized part of the substrate 580. Nonetheless, the interface may not be a straight-line.

The pores 571A of each anodic oxide coating 571 contain dye 571B. The magnesium diaphragm 500 is therefore dyed. The dye 571B coloring the anodic oxide coating 571 is one that is utilized to dye aluminum-alloy products that have been subjected to, for example, alumite treatment. For convenience of the explanation, the anodic oxide coating 571 shown in FIG. 2 has the plurality of pores 571A filled with the dye 571B to form a regular tread. In effect, however, the dye 571B sticks to the surface of each pore 571A, and the anodic oxide coating 571 is partly exposed around the opening side of the the pore 571A, thus forming an irregular tread.

The electrodeposition coating 572 is an electrically deposited thin coating provided on an anodic oxide coating 571 that is dyed and formed through anodic oxidation, and is 2 μm to 30 μm thick, for example. As shown in FIG. 2, the electrodeposition coating 572 covers the entire surface of the anodic oxide coating 571, closing the pores 571A made in the anodic oxide coating 571. If the electrodeposition coating 572 is less than 2 μm thick, the magnesium diaphragm 500 may be rusted. If the electrodeposition coating 572 is more than 30 μm thick, the magnesium diaphragm 500 may be so heavy to have but low sensitivity, failing to have characteristics required of any diaphragm. It is therefore desired that the electrodeposition coating 572 be 2 μm to 30 μm thick, more preferably 4 μm to 10 μm thick.

The electrodeposition coating 572 is made of acrylic resin prepared by polymerizing acryl, acrylic acid and a derivative thereof, epoxy resin, rubber-based resin, or elastomer resin. More specifically, the electrodeposition coating 572 is made of resin such as ester methacrylate ($CH_2C(CH_3)COOR$ (R: alkyl group) or acrylic ester ($CH_2CHCOOR$ (R: alkyl group). Acrylic resin is desirable because it is light, can form a coating of any thickness, is resistant to both light and weather, has good coloring property and is greatly adhesive.

The voice coil 600 has a cylindrical coil bobbin 610 and a coil 620. The coil bobbin 610 is made of, for example, synthetic resin. The coil 620 is wound around the coil bobbin 610. The coil bobbin 610 has one axial end secured, by use of adhesive or the like, to the joint section between the vibrating section 510 and edge section 540 of the magnesium diaphragm 500. Therefore, the voice coil 600 is connected to the magnesium diaphragm 500. The coil 620 can move in the axial direction of the coil bobbin 610, without entering the magnetic gap that is provided between the cylindrical section 220 of the yoke 200 and the yoke plate 420 of the magnetic body 400. The vibrating section 510 is so arranged to cover the magnetic body 400. The coil 620 may be coupled directly to the magnesium diaphragm 500. Both end parts of the coil 620 are guided outside, making a terminal for receiving an audio signal.

[Rust-preventive Treatment on the Magnesium Diaphragm]

Figure 3A:
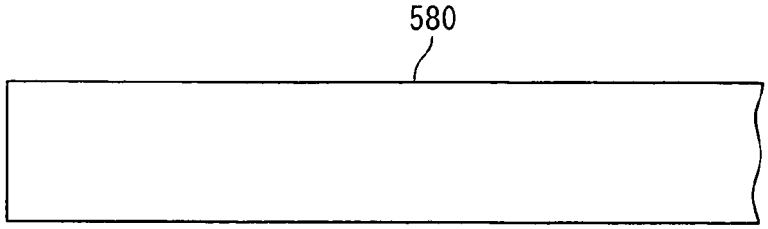
FIGS. 3A to 3D explain how the magnesium diaphragm undergoes a rust-preventive treatment.
Figure 3B:
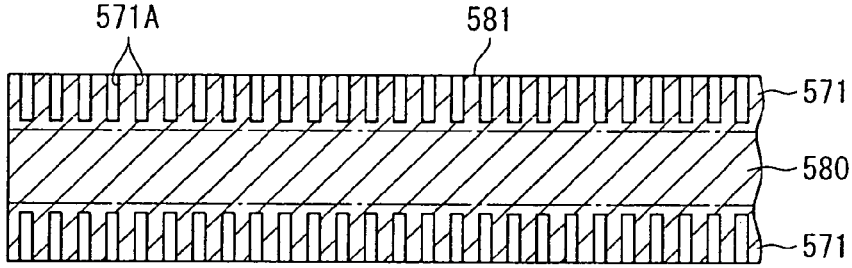
Figure 3C:
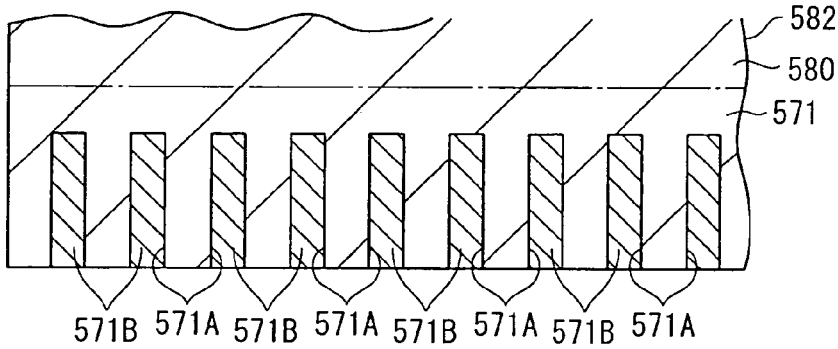
Figure 3D:
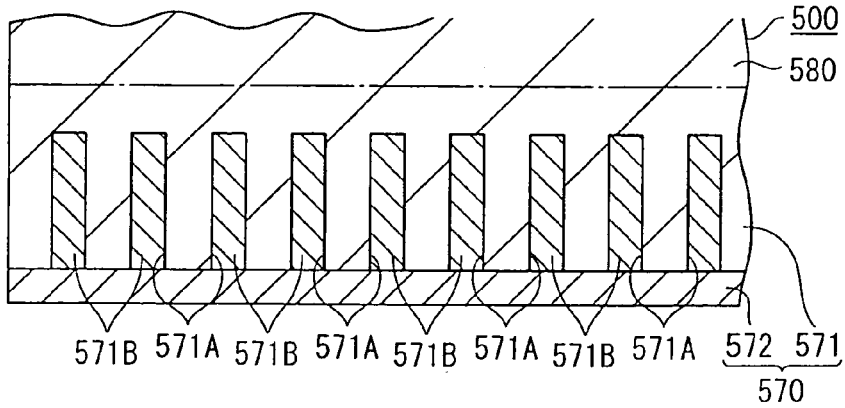

How the rust-preventive treatment is carried out on the magnesium diaphragm 500 will be explained with reference to FIGS. 3A to 3D. FIG. 3A is a sectional view showing the substrate 580. FIG. 3B is a sectional view of a first treated substrate 581 subjected to anodic oxidation. FIG. 3C is a sectional view of a second treated substrate 582 subjected to a coloring process. FIG. 3D is a sectional view of the magnesium diaphragm 500 that has undergone the rust-preventive treatment.

At first, the thin magnesium plate (not shown) is pressed to form the vibrating section 510, the edge section 540 and the flange section 550. The substrate 580 is thereby prepared as is illustrated in FIG. 3A. The substrate 580 is subjected to a pretreatment. In the pretreatment, pyrophosphate, caustic alkali or the like is applied, thereby removing grease and stain from the surface. Instead, the substrate 580 may be polished to have mirror surfaces. If polished, the substrate 580 should better be washed with surfactant or alkali.

The substrate 580 thus pre-treated is subjected to anodic oxidation. In the anodic oxidation, an electrolytic solution is used and the substrate 580 is used as anode. The electrolytic solution is, for example, an aqueous solution of alkali mixture of, for example, caustic soda and metallic salt. The pH value of the solution has been adjusted to at least 12. The substrate 580, i.e., anode, is immersed in the electrolytic solution, which is used as cathode. A predetermined voltage of, for example, 20 V to 100 V, is applied to the substrate 580 for a time ranging from 2 minutes to 20 minutes. A first treated substrate 581 having anodic oxide coatings 571 of 0.1 μm to 3 μm thickness formed thereon is thereby obtained as shown in FIG. 3B.

The first treated substrate 581 formed through anodic oxidation and shown in FIG. 3B, is subjected to a coloring process. In the coloring process, the first treated substrate 581 is immersed in a dye aqueous solution of a dye that is used to dye aluminum-alloy products that have been subjected to, for example, alumite process. While the first treated substrate 581 remains in the bath of the dye aqueous solution, the solution fills the pores 571A of the anodic oxide coating 571. A second treated substrate 582 thus dyed is obtained as is illustrated in FIG. 3C.

The dyed second treated substrate 582 shown in FIG. 3C is subjected to electrodeposition. The electrodeposition is an anion-type one, which uses an electrodeposition paint in which acrylic resin is dissolved. In the electrodeposition, the second treated substrate 582, which is the anode, and the cathode are immersed in the electrodeposition paint. While the second treated substrate 582 remains in the bath of the paint, a voltage of, for example, 20 V to 100 V is applied for 10 seconds to 120 seconds. Acrylic resin is therefore deposited on the surface of the second treated substrate 582, thus forming electrodeposition coatings 572 of 2 μm to 30 μm thickness as shown in FIG. 3D. Thereafter, the second treated substrate 582 having the electrodeposition coatings 572 is heated at, for example, 60° C. to 100° C. for a time ranging from 30 minutes to 60 minutes. As a result, a magnesium diaphragm 500 having the layered coatings 570 is produced.

[Advantages of the Speaker Apparatus]

In the embodiment described above, the substrate 580 formed by bending a thin magnesium plate made mainly of magnesium and subjected to anodic oxidation, forming the anodic oxide coatings 571 on the surfaces of the substrate 580. Then, a dye is applied to the anodic oxide coatings 571, thereby providing a magnesium diaphragm 500. The coatings formed through the rust-preventive treatment can therefore be thin. This renders the magnesium diaphragm 500 light in weight and imparts high sensitivity to the magnesium diaphragm 500. Thus, the magnesium diaphragm 500 can have a great internal loss, as is required of any diaphragm for used in speaker apparatuses. In addition, the magnesium diaphragm 500 is so dyed to have metallic gloss and thus acquires a high decorative value.

The electrodeposition coating 572 is electrically deposited on the colored anodic oxide coating 571. The magnesium diaphragm 500 therefore has high anti-corrosiveness. The magnesium diaphragm 500 can maintain its good characteristics for a long time, without being rusted even if it the speaker apparatus 100 is used in an automobile. Since the electrodeposition coatings 572 contain a dye, they need not have a color coating to add a decorative value and are as thin and light as desired. This imparts high sensitivity to the electrodeposition coatings 572 and good characteristics. Made of acrylic resin, the electrodeposition coatings 572 have a larger internal loss than the substrate 580 made of magnesium. Hence, the electrodeposition coatings 572 can reduce the resonance that inevitably occurs when the electrodeposition coatings 572 are vibrated. In other words, the coatings help to impart good characteristics to the speaker apparatus 100.

As specified above, the anodic oxide coatings 571 formed through anodic oxidation are 0.1 μm to 3 μm thick. The anodic oxide coatings 571 are thick enough to impart sufficient anti-corrosiveness. They are yet thick enough to enable the magnesium diaphragm 500 to be readily pressed and to generate sound of desired quality.

As indicated above, the anodic oxide coatings 571 are formed by immersing the substrate 580 in an aqueous solution of alkali mixture, the pH value of which has been adjusted to at least 12. The thickness the anodic oxide coating 571 can be reliably controlled, with an error smaller than ±2 μm. This helps to increase the yield of the magnesium diaphragm 500 that has desired characteristics.

The aqueous solution is one that contains an alkali mixture of caustic soda and metallic salt. The anodic oxide coatings 571 formed by the use of this solution have no surface irregularities.

As mentioned above, a voltage of 20 V to 100 V is applied to the substrate 580 for a time ranging from 2 minutes to 20 minutes, thus forming the anodic oxide coatings 571. This is another reason why the anodic oxide coatings 571 have no surface irregularities.

As specified above, the electrodeposition coatings 572 are made by using an electrodeposition paint that is made mainly of acrylic resin. Hence, the electrodeposition coatings 572 are resistant to both light and weather. As a result, the anodic oxide coatings 571 dyed with the paint have good coloring property. This enhances the decorative value of the magnesium diaphragm 500.

The electrodeposition coating 572 is 2 μm to 30 μm thick, as set forth above. Hence, the magnesium diaphragm 500 can not only have high anti-corrosiveness, but also be light enough to acquire high sensitivity.

In the electrodeposition, a voltage of, for example, 20 V to 100 V is applied for 10 seconds to 120 seconds to the second treated substrate 582, thereby forming electrodeposition coating 572. The electrodeposition coatings 572 thus formed have no surface irregularities. Since the electrodeposition is an anion-type one, the electrodeposition coatings 572 are greatly resistant to light. Hence, the speaker apparatus 100 can easily acquire high versatility.

As mentioned earlier, the layered coating 570, composed of the anodic oxide coating 571 and the electrodeposition coating 572, has a thickness ranging from 5 μm to 10 μm. This makes it possible for the speaker apparatus 100 to acquire not only such high anti-corrosiveness as is required of any speaker apparatus but also be light enough to acquire high sensitivity particularly for use in automobiles. Further, good characteristics as a diaphragm can easily be obtained.

As specified above, the magnesium diaphragm 500 is made by processing a thin magnesium plate having a thickness of 60 μm or less. This is why the magnesium diaphragm 500 exhibits high sensitivity.

[Other Embodiments]

The present invention is not limited to the embodiment described above. Rather, various modifications can be made to achieve the object of the invention.

For example, the magnesium diaphragm 500 can have any shape other than the above-described shape. The magnesium diaphragm 500 may be of outer-magnet type, inner-magnet type, or any other type, whichever type suitable in view of the configuration of the speaker apparatus 100. Moreover, the speaker apparatus 100 is need not be a tweeter that is a small speaker for generating high-frequency sound. Instead, the speaker apparatus 100 may be a speaker that generates intermediate-frequency sound or low-frequency sound. Alternatively, the speaker apparatus 100 may be a dome-shaped speaker, a cone-shaped speaker, a flat speaker, or a horn speaker.

The thin magnesium plate is not limited to one that is 60 μm or less thick. It may have any other thickness.

The magnesium diaphragm 500 has layered coating 570 composed of the anodic oxide coating 571 and the electrodeposition coating 572. Instead, the layered coating 570 may be formed of only the dyed anodic oxide coating 571.

Further, the anodic oxide coating 571 may have a thickness that falls outside the range of 0.1 μm to 3 μm. Similarly, the electrodeposition coating 572 may have a thickness that falls outside the range of 2 μm to 30 μm.

The electrolytic solution used in the anodic oxidation is not limited to an alkali-mixture aqueous solution that contains metallic salt. The pH value of the solution does not have to be 12 or more. The conditions of the anodic oxidation can be changed; they are not limited to those specified above, i.e., a voltage ranging 20 V to 100 V applied for 2 minutes to 20 minutes.

The dye is not limited to the one specified above.

As mentioned above, the electrodeposition coatings 572 are made of electrodeposition paint that is made mainly of acrylic resin. Nonetheless, the electrodeposition coatings 572 can be made of any other electrodeposition paint.

In the electrodeposition, a voltage of 20 V to 100 V is applied for 10 seconds to 120 seconds. The electrodeposition can be performed in any other conditions.

The configuration of the above-described embodiment and the sequence of manufacturing the embodiment can be changed as is needed, in order to accomplish the object of the invention.

[Advantages of the Embodiment]

As has been described above, the anodic oxidation is performed on a thin magnesium plate made mainly of magnesium, thereby forming anodic oxide coatings 571 on the surface thereof. A dye is applied to the anodic oxide coatings 571. Hence, the coatings formed in the rust-preventive treatment can be thin. The magnesium diaphragm 500 can therefore be light enough to have high sensitivity. The magnesium diaphragm 500 also has a great internal loss and can therefore be fit for use in the speaker apparatus 100. In addition, the magnesium diaphragm 500 is so dyed to have metallic gloss. It can therefore acquire a high decorative value.

What is claimed is:

1. A magnesium diaphragm comprising a thin magnesium plate made mainly of magnesium, wherein an anodic oxide coating is formed on both surfaces of the thin magnesium plate, the anodic oxide coating is provided with a plurality of closed pores and is dyed by filling a dye in the closed pores, and an electrodeposition coating is provided on the anodic oxide coating.

2. The magnesium diaphragm according to claim 1, wherein the anodic oxide coating has a thickness of 0.1 mm to 3 mm.

3. The magnesium diaphragm according to claim 1, wherein the anodic oxide coating is formed by anodic oxidation using an alkali-mixture aqueous solution containing metallic salt and haying a pH value of at least 12.

4. The magnesium diaphragm according to claim 1, wherein the anodic oxide coating is formed by applying a voltage of 20 V to 100 V for 2 minutes to 20 minutes.

5. The magnesium diaphragm according to claim 1, wherein the electrodeposition coating is formed by using electrodeposition paint made mainly of acrylic resin.

6. The magnesium diaphragm according to claim 1, wherein the electrodeposition coating has a thickness of 2 mm to 30 mm.

7. The magnesium diaphragm according to claim 1, wherein the electrodeposition coating is formed by applying a voltage of 20 V to 100 V for 2 minutes to 20 minutes.

8. The magnesium diaphragm according to claim 1, wherein a total thickness of the anodic oxide coating and the electrodeposition coating is 5 mm to 15 mm.

9. The magnesium diaphragm according to claim 1, wherein the thin magnesium plate has a thickness of at most 60 mm.

* * * * *

UNITED STATES PATENT AND TRADEMARK OFFICE

CERTIFICATE OF CORRECTION

PATENT NO. : 7,454,032 B2
APPLICATION NO. : 10/921911
DATED : November 18, 2008
INVENTOR(S) : Hiroyuki Tomiyama et al.

It is certified that error appears in the above-identified patent and that said Letters Patent is hereby corrected as shown below:

On the Title page:

Item "(73)" Assignee: "PIONEER CORPORATION"

Should read:

Item "(73)" Assignee: -- PIONEER CORPORATION, TOKYO, JAPAN;
TOHOKU PIONEER CORPORATION, TENDO -SHI, JAPAN --

Signed and Sealed this

Twenty-fifth Day of August, 2009

David J. Kappos

David J. Kappos
*Director of the United States Patent and Trademark Office*